US009481433B2

(12) United States Patent
Yeh

(10) Patent No.: US 9,481,433 B2
(45) Date of Patent: Nov. 1, 2016

(54) PADDLE

(71) Applicant: Tzong In Yeh, Fremont, CA (US)

(72) Inventor: Tzong In Yeh, Fremont, CA (US)

(73) Assignee: AGIT GLOBAL IP HOLDINGS, LLC, Irvine, CA (US)

( * ) Notice: Subject to any disclaimer, the term of this patent is extended or adjusted under 35 U.S.C. 154(b) by 462 days.

(21) Appl. No.: 14/077,759

(22) Filed: Nov. 12, 2013

(65) Prior Publication Data

US 2014/0133997 A1 May 15, 2014

(30) Foreign Application Priority Data

Nov. 12, 2012 (TW) ..... 101142085 A

(51) Int. Cl.
*B63H 16/04* (2006.01)

(52) U.S. Cl.
CPC ..... *B63H 16/04* (2013.01)

(58) Field of Classification Search
CPC ..... B63H 16/00; B63H 16/04
See application file for complete search history.

(56) References Cited

U.S. PATENT DOCUMENTS

| | | | | |
|---|---|---|---|---|
| 1,817,414 A * | 8/1931 | Korth | B63H 16/04 | 403/301 |
| 2,711,547 A * | 6/1955 | Bliven | B63H 16/04 | 403/349 |
| 3,052,897 A * | 9/1962 | Martin | A63B 35/06 | 416/70 R |
| 4,147,469 A * | 4/1979 | Sherberne | B63H 16/04 | 416/70 R |
| 8,057,271 B2 * | 11/2011 | Hevesi | B63H 16/04 | 416/74 |

* cited by examiner

*Primary Examiner* — Igor Kershteyn
(74) *Attorney, Agent, or Firm* — Muncy, Geissler, Olds & Lowe, P.C.

(57) ABSTRACT

A paddle is disclose, the paddle comprises a blade, an intensified structure and a handle. The blade comprises a body and a tubular section extending from the body. The body is provided with a reception hollow communicated with the interior of the tubular section. The intensified structure comprises a joint section and an intensified section, where one end of the joint section engages fixedly in the inside of the tubular section of the blade. The handle is joined to the other end of the joint section. The paddle of this invention exploits the intensified structure to heighten the structural strength of the blade, which substantially decreases the possibility of breakage of the blade due to the propelling force.

7 Claims, 4 Drawing Sheets

PADDLE

BACKGROUND OF THE INVENTION

1. Field of the Invention

The present invention disclosed herein relates, in general, to paddles. More specifically, the present invention relates to a paddle characterizing an intensified structure and avoiding breakage during its use.

2. Description of the Prior Art

The conventional paddle is formed with a handle and a blade. Specifically, the blade is a hollow plate, where the plate is provided with a tubular section at its proximal end, and an opening is formed at the tubular section's end face. The handle engages in the opening with its proximal end, to attach to the blade. It is noted that when the conventional paddle is in use, due to the bigger surface area of the blade, the resistance is relatively greater, where the blade is therefore easily subjected to breakage, and the breakage is especially likely to occur at the intersection of the tubular section of the blade and the plate.

SUMMARY OF THE INVENTION

The objective of the present invention is to provide a paddle, featuring an intensified structure for heightening its strength and avoiding breakage during its use.

Specifically, the paddle comprises a blade, an intensified structure and a handle. The blade comprises a body and a tubular section extending from the body. The body is provided with a reception hollow communicated with the interior of the tubular section. The intensified structure comprises a joint section and an intensified section, where a first end of the joint section engages fixedly in the inside of the tubular section of the blade while the intensified section extends from the first end of the joint section and engages in the reception hollow of the body of the blade. The handle is joined to the second end of the intensified section.

Moreover, the body of the blade is provided with a topside surface and an underside surface, and is provided with a bend at the distal end of the body. The intensified structure preferably comprises a sleeve, covering the proximal end of the intensified section, and the sleeve is made from rubber substance. The sleeve is provided with a first side segment and a second side segment which are located at two opposite sides of the proximal end of the intensified section respectively and in between the proximal end of the intensified section and the inner wall of the body of the blade, where the first side segment is ear to the topside surface of the body of the blade, and the second side segment is near to the underside surface of the body of the blade and the first side segment is bigger than the second side segment.

The paddle preferably comprises a first pin and a second pin. The blade is provided with a through hole at the wall of its tubular section. The intensified structure is provided with a first hole at the outer wall of its joint section, where the first hole is aligned with the through hole of the tubular section. The first pin is inserted through the through hole of the tubular section and the first hole of the joint section. The paddle further comprises a ring sleeve, covering the outer wall of the tubular section of the blade, for the purpose of concealing the through hole of the tubular section.

On the other hand, the intensified structure is provided with a second hole at the outer wall of its joint section, and is provided with a hollow cover, covering the outer wall of the second end of the joint section, where the hollow cover is provided with a hole aligned with the second hole. The second pin is inserted through the hole of the hollow cover and the second hole of the joint section.

Compared with prior techniques, this invention provides a novel paddle, which exploits the intensified structure to engage its intensified section in the inside of the body of the blade, to achieve the purpose of intensifying the strength of the blade itself, which effectively lowers the breakage of the blade while the paddle is in use, to extend the lifespan of the use of the paddle.

Further novel features and other objects of the present invention will become apparent from the following detailed description, discussion and the appended claims, taken in conjunction with the drawings.

DETAILED DESCRIPTION OF THE INVENTION

Figure 1:
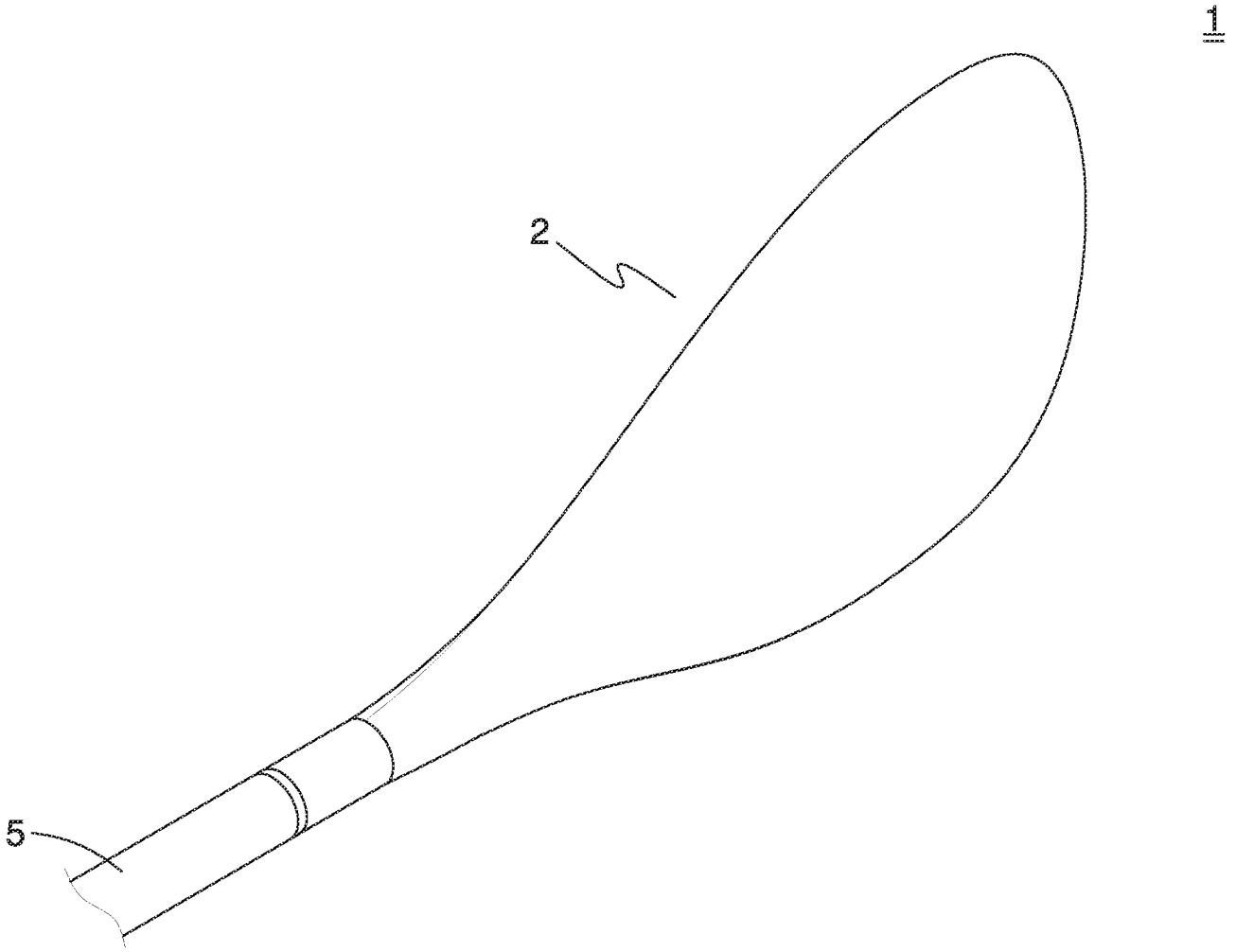
FIG. 1 is a perspective view of the paddle of a preferred embodiment of the present invention.
Figure 2:
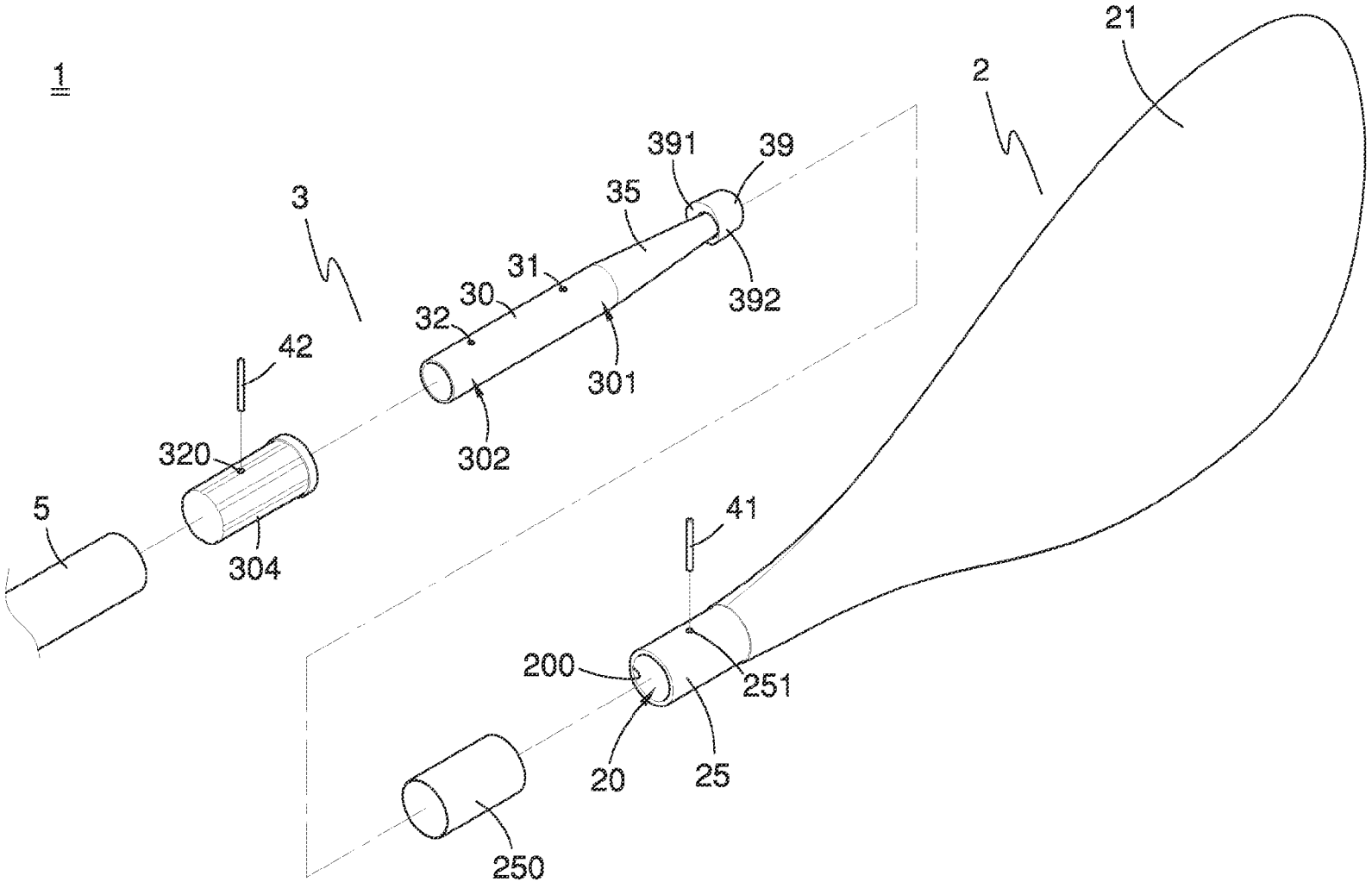
FIG. 2 is an exploded view of the preferred embodiment.

FIGS. 1 and 2 present the paddle of the preferred embodiments of this invention. The paddle 1 comprises a blade 2, an intensified structure 3 and a handle 5, where proximal end of the intensified structure 3 engages in the blade 2 to intensify the strength of the structure of the blade 2 while the distal end is to join the handle 5.

Figure 3:
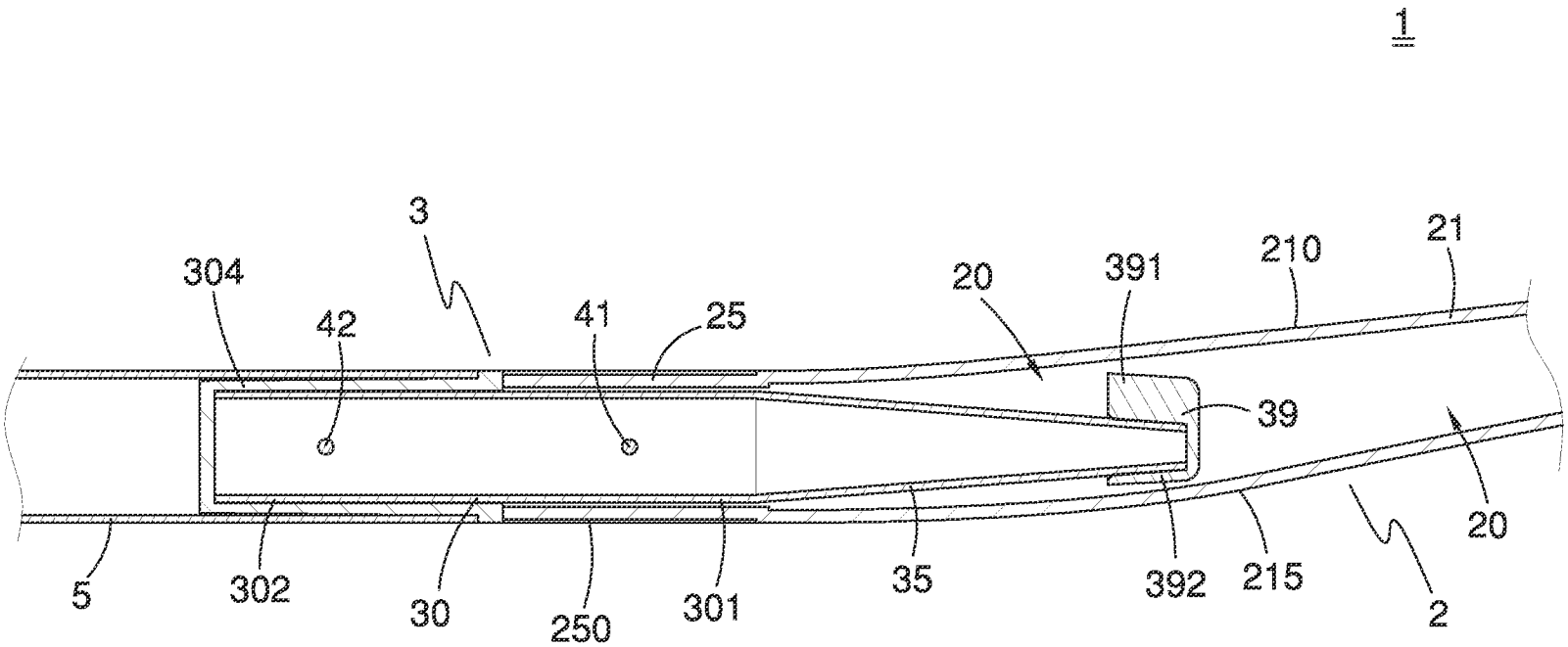
FIG. 3 is a partial cross-sectional view of the preferred embodiment.

Referring to FIGS. 2 and 3, the blade 2 comprises a body 21 and a tubular section 25 extending from the body 21. The body 21 is provided with a topside surface 210 and an underside surface 215, and a bend at its distal end. The body 21 is provided with a reception hollow 20 communicated with the interior of the tubular section 25. The tubular section 25 is provided with an opening 200 at its proximal end face. The intensified structure 3 comprises a joint section 30, an intensified section 35 extending from a first end 301 of the joint section 30, and a sleeve 39. Preferably, the blade 2 is made from plastic substance, and the joint section 30 and the intensified section 35 are made of metal substance while the sleeve 39 is made from rubber substance or other substance with elasticity. The first end 301 and a second end 302 of the joint section 30 are used to join the blade 2 and the handle 5 respectively. Described in detail, the first end 301 of the joint section 30 engages in the tubular section 25 of the blade 2, where the first hole 31 of the joint section 30 is aligned with a through hole 251 of the tubular section 25. A first pin 41 is inserted through the through hole 251 of the tubular section 25 and the first hole 31 of the joint section 30, which exploits the tubular section 25 of the blade 2 and the first end 301 of the joint section 30 to join together fixedly. Besides, the intensified section 35 tapers off from the first end 301 of the joint section 30 toward its proximal end and engage in the reception hollow 20 of the body 21 of the blade 2. Accordingly, once the paddle 1 is in use, due to the support by the intensified section 35 in the body 21 of the blade 2, the possibility of breakage of the body 21 due to the exertion of force can be substantially lowered, especially the possibility of breakage at the intersection of the body 21 of the blade 2 and the tubular section 25, which prolongs the lifespan of the use of the paddle 1.

Figure 4:
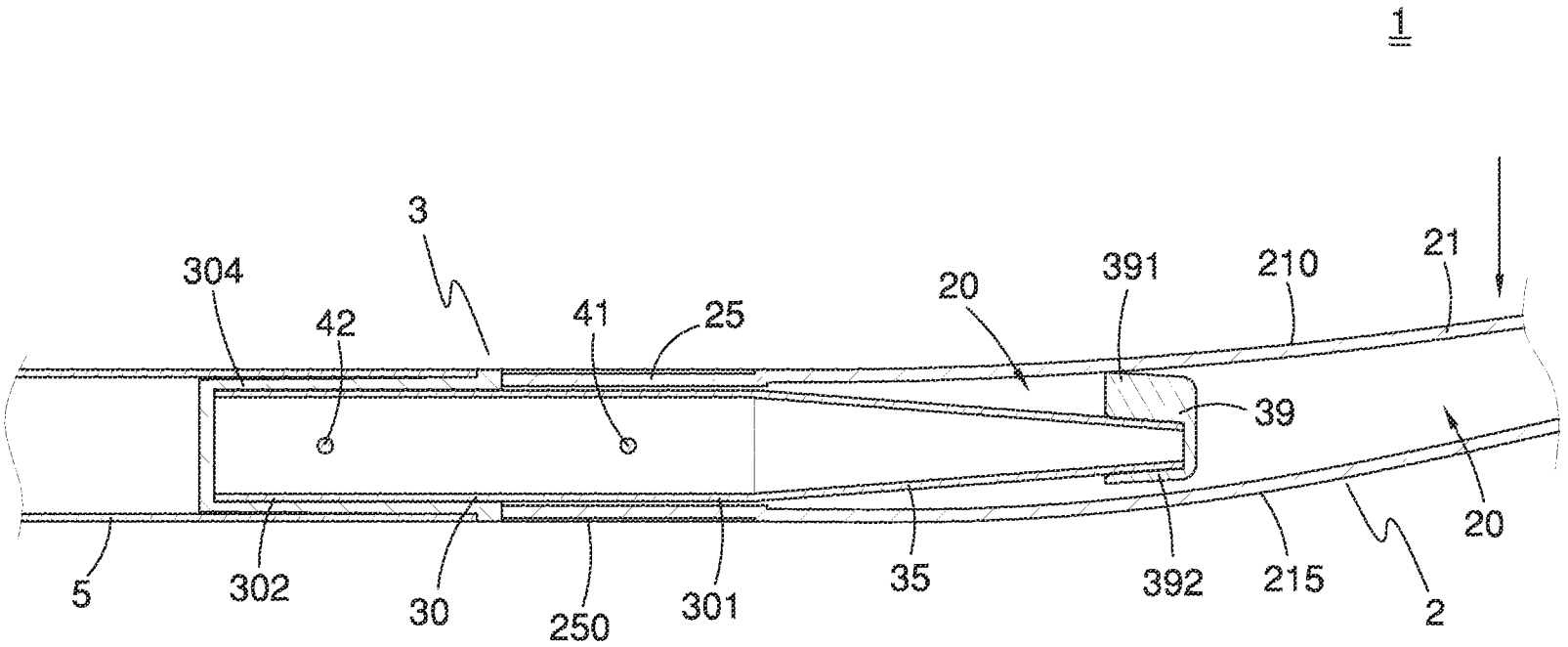
FIG. 4 is a partial cross-sectional view with the exertion of force applied to the preferred embodiment.

Moreover, the sleeve 39 is placed over the proximal end of the intensified section 35, and is provided with a first side segment 391 and a second side segment 392, which are located at two opposite sides of the proximal end of the intensified section 35 respectively, where the first side segment 391 is near to the topside surface 210 of the body 21 of the blade 2, and the second side segment 392 is near to the underside surface 215 of the body 21 of the blade 2 and the first side segment 391 is bigger than the second side segment 392. Accordingly, as shown in FIG. 4, once the paddle 1 is in use for propelling a boat, the sleeve 39 can effectively keep the inner wall of the inner side of the topside surface 210 of the body 21 from producing friction with the intensified section 35.

Again, referring to FIGS. 2 and 3, the joint section 30 further comprises hollow cover 304, covering the outer wall of the second end 302 of the joint section 30, where the hollow cover 304 is provided with a hole 320 aligned with the second hole 32 of the joint section 30, and by means of the insertion of a second pin 42 through the hole 320 of the hollow cover 304 and the second hole 32 of the joint section 30, the hollow cover 304 joins fixedly to the second end 302 of the joint section 30. Besides, in this embodiment, the handle 5 is designated to put on the hollow cover 304, and the outer wall of the hollow cover 304 is designated to taper off toward the handle 5, to help the handle 5 to be put thereon, and joins to the paddle 1; however, the actual realization is not limited thereof.

On the other hand, the paddle 1 further comprises a ring sleeve 250, covering the tubular section 25 of the blade 2, for the concealment of the through hole 251 of the tubular section 25.

Compared with prior techniques, this invention provides a novel paddle, which features the aforementioned intensified structure that heightens the strength of its structure, to achieve the purpose of lowering the possibility of breakage, so as to extend the lifespan of the use of the paddle.

By any means, anyone may obtain enough teaching from the foregoing description to understand that the contents of this invention is different from the prior techniques, and has industrial applicability, and inventive steps. The present invention conforms to the requirements for a patent.

What is claimed is:

1. A paddle, comprising:

a blade, comprising a body and a tubular section extending from the body, where the body is provided with a reception hollow communicated with the interior of the tubular section;

an intensified structure, comprising a joint section, an intensified section and a sleeve, where a first end of the joint section engages fixedly in the inside of the tubular section of said blade while the intensified section extends from the first end of the joint section and engages in the reception hollow of the body of said blade, and tapers off from the first end of the joint section toward a proximal end thereof in a manner that the intensified section is substantially suspended within the reception hollow of the body of the blade, wherein the sleeve covers the proximal end of the intensified section and is made from rubber substance; and a handle, coupled to a second end of the intensified section of said intensified structure.

2. The paddle as claimed in claim 1, wherein the sleeve is provided with a first side segment and a second side segment which are located at two opposite sides of the proximal end of the intensified section respectively; a distal end of the body of said blade having a bend that is curved upward, and being provided with a topside surface and a underside surface; the first side segment being near to the topside surface of the body of said blade, the second side segment being near to the underside surface of the body of said blade, and the first side segment being bigger than the second side segment.

3. A paddle, comprising:

a blade comprising a body and a tubular section extending from the body, where the body is provided with a reception hollow communicated with the interior of the tubular section;

an intensified structure comprising a joint section and an intensified section, where a first end of the joint section engages fixedly in the inside of the tubular section of said blade while the intensified section extends from the first end of the joint section and engages in the reception hollow of the body of said blade; and a handle coupled to a second end of the intensified section of said intensified structure;

wherein said intensified structure is provided with a hollow cover, covering the outer wall of the second end of the joint section.

4. A paddle, comprising:

a blade comprising a body and a tubular section extending from the body, where the body is provided with a reception hollow communicated with the interior of the tubular section;

an intensified structure comprising a joint section and an intensified section, where a first end of the joint section engages fixedly in the inside of the tubular section of said blade while the intensified section extends from the first end of the joint section and engages in the reception hollow of the body of said blade; and a handle coupled to a second end of the intensified section of said intensified structure;

wherein the paddle further comprises a first pin; said blade being provided with a through hole at the wall of its tubular section; a first hole being disposed at the outer wall of the joint section, where the first hole is aligned with the through hole of the tubular section; the first pin being inserted through the through hole of the tubular section and the first hole of the joint section.

5. The paddle as claimed in claim 4, wherein the paddle further comprises a ring sleeve, covering the outer wall of the tubular section of said blade, to conceal the through hole of the tubular section.

6. The paddle as claimed in claim 4, wherein the paddle further comprises a second pin; said intensified structure being provided with a hollow cover, covering the outer wall of the second end of the joint section, and the hollow cover being provided with a hole; a second hole being disposed at the outer wall of the joint section, where the second hole is aligned with the hole of the hollow cover; the second pin being inserted through the hole of the hollow cover and the second hole of the joint section.

7. The paddle as claimed in claim 5, wherein the paddle further comprises a second pin; said intensified structure being provided with a hollow cover, covering the outer wall of the second end of the joint section, and the hollow cover being provided with a hole; a second hole being disposed at the outer wall of the joint section, where the second hole is aligned with the hole of the hollow cover; the second pin being inserted through the hole of the hollow cover and the second hole of the joint section.

* * * * *